United States Patent [19]

Halboth et al.

[11] Patent Number: 4,993,100

[45] Date of Patent: Feb. 19, 1991

[54] DEVICE FOR CLEANING ELECTRICAL CONNECTOR MALE AND FEMALE CONTACT PINS AND RECEPTACLE

[76] Inventors: Llewellyn J. Halboth, 3320 S. Richfield Way; David F. Pascuzzi, 15703 E. Caspian Cir., #306, both of Aurora, Colo. 80013

[21] Appl. No.: 410,080

[22] Filed: Sep. 20, 1989

[51] Int. Cl.[5] ..... A47L 25/00

[52] U.S. Cl. ..... 15/118; 15/104.94; 15/210 R

[58] Field of Search ..... 15/105, 106, 104.94, 15/143 R, 160, 118, 210 R

[56] References Cited

U.S. PATENT DOCUMENTS

| | | | |
|---|---|---|---|
| 2,914,785 | 12/1959 | Ela | 15/143 R |
| 3,080,594 | 3/1963 | Race | 15/210 R |
| 3,705,436 | 12/1972 | Holliday | 15/210 R |
| 3,807,010 | 4/1974 | Semrad | 29/203 H |
| 4,065,801 | 12/1977 | Leaming | 360/137 |
| 4,130,912 | 12/1978 | Sheppard et al. | 15/210 R |
| 4,204,294 | 5/1980 | Halverson | 15/106 |
| 4,207,644 | 6/1980 | Westran | 15/210 R |
| 4,263,692 | 4/1981 | Gremillion | 15/210 R |
| 4,428,092 | 1/1984 | Lipari | 15/210 R |
| 4,575,892 | 3/1986 | Ross | 15/160 |
| 4,631,616 | 12/1986 | Zago et al. | 360/128 |
| 4,637,089 | 1/1987 | Schwarz | 15/118 |
| 4,641,391 | 2/1987 | De Brey | 15/104.94 |
| 4,654,921 | 4/1987 | Dinner | 15/143 R |
| 4,733,678 | 3/1988 | Bolois | 134/115 R |
| 4,792,876 | 12/1988 | Cook et al. | 360/128 |

*Primary Examiner*—Philip R. Coe
*Assistant Examiner*—Mark Spisich
*Attorney, Agent, or Firm*—John R. Flanagan

[57] ABSTRACT

An electrical connector contact cleaning device includes an elongated rectangular plastic holder body with a cleaning cavity having a cleaning pad being disposed on one end of the body for receiving and cleaning a row of male electrical connector contact pins, and a cleaning protrusion having a cleaning pad being disposed on the opposite end of the body for inserting into and cleaning a female electrical connector contact receptacle. The body has open slots defined through it between its opposite ends for facilitating gripping of the cleaning device by a user's hand.

14 Claims, 2 Drawing Sheets

DEVICE FOR CLEANING ELECTRICAL CONNECTOR MALE AND FEMALE CONTACT PINS AND RECEPTACLE

BACKGROUND OF THE INVENTION

1. Field of the Invention

The present invention generally relates to cleaning contacts of electrical connectors and, more particularly, is concerned with a device for cleaning male and female contact pins and receptacle of electrical connectors, such as on a video game cassette and video game playing machine.

2. Description of the Prior Art

Home video games are a highly popular recreational activity. These games are contained in video game cassettes sold or rented to consumers at retail stores. They are played on a video display, such as a computer video display terminal or a home television screen, and operated by a video game playing machine interfaced with the computer or television. Video game playing machines can be purchased or rented by consumers for home use. The video game cassette plugs into the video game playing machine via mating of male contact pins on the cassette with a female contact receptacle on the machine.

The construction of a video game cassette itself is reasonably durable and can accommodate heavy use. However, retailers have experienced a relatively high rate of return of video game cassettes because consumers have encountered difficulty at times in getting games to play consistently and reliably on the video playing machines. The inventors herein have discovered that, in the vast majority of the returns they have examined, the source of the problem merely has been the accumulation of foreign matter, i.e., dirt, on the contacts of the video game cassette and/or video playing machine which up to the present consumers have been unable to remove.

At the present time, there are a variety of devices available for cleaning audio tapes and player heads, video cassette tapes and recorders, compact disks and players and computer disks and drives. Unfortunately, none of these devices are particularly suited for use in cleaning electrical connector contacts of video game cassettes and video playing machines. Cleaning of the contacts of these components has been attempted by use of a Q-Tip applicator stick or a conventional wiping rag or cloth. However, all of these approaches have proven to be tedious, ineffective and unreliable.

Consequently, a pressing need exists for a device which will allow consumers to easily and effectively clean the contacts of these components and thereby substantially reduce, if not eliminate entirely, the high incidence of unnecessary store returns of this otherwise highly reliable product.

SUMMARY OF THE INVENTION

The present invention provides an electrical connector contact cleaning device designed to satisfy the aforementioned needs. The cleaning device of the present invention is particularly suited for use in cleaning the male and female contact pins and receptacle of electrical connectors respectively found on video game cassettes and video game playing machines which operate the video game cassettes. However, the cleaning device is not so limited in its potential applications. It can be used for cleaning electrical connector contacts of comparable configurations on any electronic circuitry.

Accordingly, the present invention is directed to an electrical connector contact cleaning device which comprises: (a) an elongated body; (b) means on the body for receiving and cleaning at least one and preferably a row of male electrical connector contact pins; and (c) means on the body for inserting into and cleaning a female electrical connector receptacle.

More particularly, the male contact pin cleaning means includes a support member having inner and outer opposite ends and opposite lateral sides extending therebetween. The support member is attached at its inner end to the body, projects outwardly therefrom, and has a slot which is open at the sides and outer end of the support member. A cleaning material in the form of a pad is removably attached to the support member within slot so as to define a cleaning cavity therein for receiving the male contact pins in engagement with the cleaning pad.

The female contact receptacle cleaning means includes a support flange having inner and outer opposite ends and opposite surfaces extending therebetween. The support member is attached at its inner end to the body and projects outwardly therefrom. A cleaning material in the form of a pad is attached to the support flange and overlies the opposite surfaces and outer end thereof so as to define a cleaning protrusion thereon for receiving the female receptacle over the support flange in engagement with the cleaning pad.

Also, the cleaning device includes means on the body located between opposite ends thereof for gripping the device. The cleaning device body includes a perimeter frame composed of opposing side members interconnected by opposing end members and defining therewith a central opening, and a plurality of cross members extending across the central opening between and interconnected with the side members of the frame. The cross members are spaced from one another and from the end members of the frame so as to divide the central opening into a plurality of open slots for inserting a finger of a user's hand to grip said body. The slots in the body define the gripping means.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
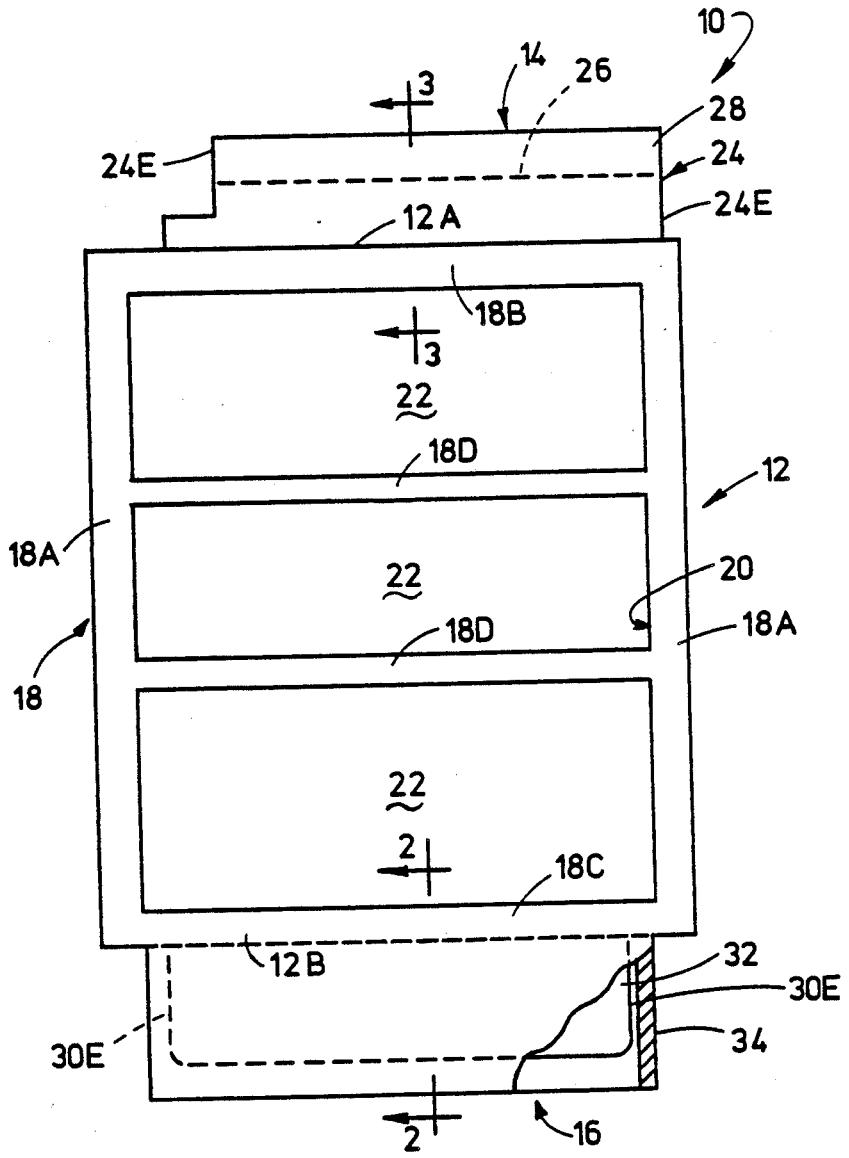
FIG. 1 is a top plan view of an electrical connector contact cleaning device of the present invention.

Referring to FIGS. 1–5 of the drawings, there is shown an electrical connector contact cleaning device, generally designated 10, having a construction in accordance with the present invention. In its basic parts, the cleaning device 10 includes an elongated holder body 12, means defining a cleaning cavity 14 on one end 12A of the body for receiving and cleaning a row of spaced male contact pins, and means defining a cleaning protrusion 16 on the other opposite end 12B of the body for inserting into and cleaning a female contact receptacle. The row of male contact pins and the female contact receptacle not shown herein have well-known conventional constructions and are found on a wide variety of electrical connectors for electronic equipment besides video game cassettes and playing machines.

The elongated body 12 of the cleaning device 10 is preferably substantially rectangular in shape and composed of any suitable relatively rigid plastic material. The body 12 includes a generally rectangular-shaped perimeter frame 18 composed of a pair of opposing side members 18A and a pair of opposing end members 18B and 18C. The end members 18B and 18C rigidly interconnect the opposing side members 18A and define therewith a rectangular-shaped central opening 20.

Also, the body 12 preferably includes a pair of cross members 18D extending across the central opening 20 between and rigidly interconnected with the side members 18A of the frame 18. The cross members 18D are spaced from one another and from the end members 18B and 18C of the frame 18 so as to divide the central opening 20 into open slots 22 for inserting fingers of a user's hand through the body 12 to grip it. The slots 22 thus, in effect, define a gripping means on the body 12 between the opposite ends 12A and 12B of the body which facilitate the user gripping the device 10 to manipulate it from side to side in the required motion for interfacing the contacts with the cleaning cavity 14 and cleaning protrusion 16 and for cleaning the contacts.

It should be apparent that the cross members 18D could extend longitudinally between and rigidly interconnect with the end members 18B and 18C instead of the side members 18A, if desired, with the orientation of the slots 22 correspondingly changed. The device body 12 may have other configurations coming within the purview of the present invention.

Figure 3:
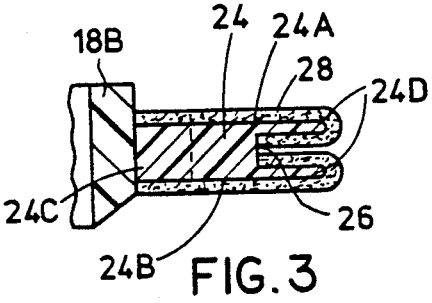
FIG. 3 is a fragmentary longitudinal sectional view of a male contact pin cleaning end of the device taken along line 3—3 of FIG. 1.
Figure 5:
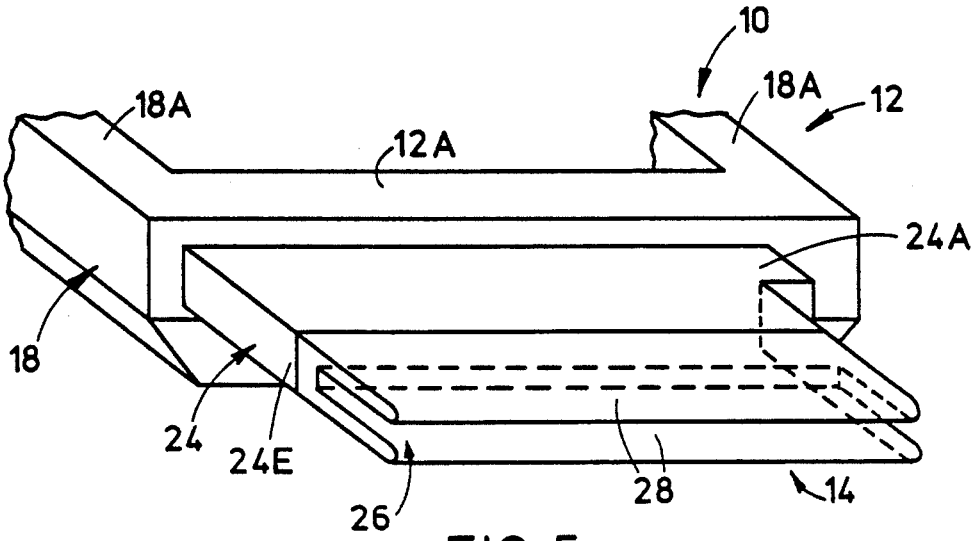
FIG. 5 is a fragmentary perspective view of the male contact pin cleaning end of the device of FIG. 1.

Referring particularly to FIGS. 1, 3 and 5, the male contact pin cleaning means 14 defining the cleaning cavity includes a support member 24, preferably, composed of plastic and having a generally flat plate-like configuration with top and bottom surfaces 24A and 24B bounded by inner and outer opposite ends 24C and 24D and opposite lateral sides 24E. The support member 24 is attached at its inner end 24C to one frame end member 18B of the body 12 and projects outwardly therefrom. The support member 24 has a groove or slot 26 defined therein which is open at the opposite sides 24E and outer end 24D of the support member.

The cleaning cavity defining means 14 also includes a cleaning material in the form of a cleaning pad 28. The cleaning pad 28 is removably attached, such as adhesively, to the top and bottom surfaces 24A and 24B of the support member 24 and to surface portions of said support member 24; within the slot 26 thereof such that the slot 26 and portions of the cleaning pad 28 extending within the slot 26; define the cleaning cavity therein for receiving the row of male contact pins in engagement with the cleaning pad 28. As seen in FIG. 5, the lateral length of the slot 26 defined between the lateral sides 24E of the flat plate-like support member 24 is greater than the depth of the slot 26 defined into the support member 24 from the outer end 24D. Thus, the cleaning cavity defined by the slot 26 and portions of cleaning pad 28 extending therein has a lateral length greater than its depth.

Figure 2:
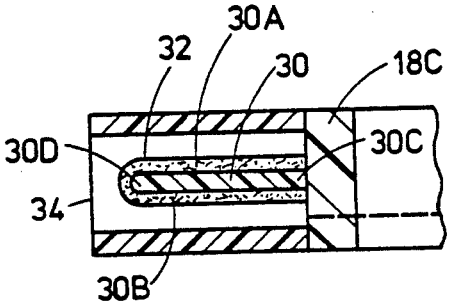
FIG. 2 is a fragmentary longitudinal sectional view of a female contact receptacle cleaning end of the device taken along line 2—2 of FIG. 1.
Figure 4:
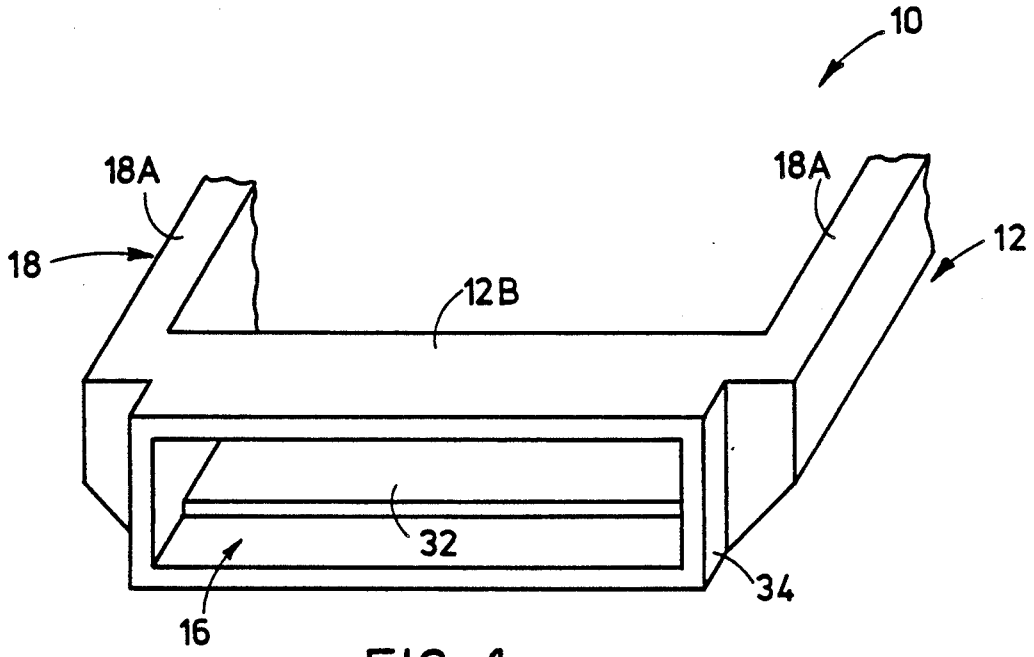
FIG. 4 is a fragmentary perspective view of the female contact receptacle cleaning end of the device of FIG. 1.

Referring particularly to FIGS. 1, 2 and 4, the female contact receptacle cleaning means 16 defining the cleaning protrusion includes a support flange 30, preferably, composed of plastic and having a generally flat plate-like configuration with top and bottom surfaces 30A and 30B bounded by inner and outer opposite ends 30C and 30D and opposite lateral sides 30E. The support flange 30 is attached at its inner end 30C to the other frame end member 18C of the body 12 and projects outwardly therefrom. The outer end 30D has a rounded edge.

The cleaning protrusion defining means 16 also includes a cleaning material in the form of a cleaning pad 32. The cleaning pad 32 is removably attached, such as adhesively, to and overlies the top and bottom surfaces 30A and 30B and rounded outer end 30D of the support flange 30 so as to define the cleaning protrusion for receiving the female contact receptacle over the support flange 30 in engagement with the cleaning pad 32. As seen in FIG. 4, the lateral length of the flat plate-like support flange 30 defined between its opposite lateral sides 30 is greater than the depth of the support flange 30 defined between its inner and outer opposite ends 30C and 30D. Thus, the cleaning protrusion defined by the support flange 30 and cleaning pad 32 removably attached to and overlying the support flange 30 has a lateral length greater than its depth.

Optionally, as seen in FIGS. 1, 2 and 4, a housing 34 can be provided, attached to and projecting from the frame end member 18C of the body 12. The hollow housing 34 covers the cleaning protrusion but is spaced therefrom so as to permit receipt of the female contact receptacle within the housing and over the protrusion.

The cleaning pads 28 and 32 are preferably composed of any suitable mildly abrasive cloth. Also, preferably the cloth selected is able to absorb a liquid electronic contact cleaner material, if desired. However, use of liquid cleaner is not required.

By moving the device 10 relative to the electrical connector contacts so as to move the cleaning pads 28 and 32 across and along the male contact pins and within the female contact receptacle, the contact surfaces can be easily cleaned. A suitable releasable adhesive is employed for attaching and removing the cleaning pads 28 and 32 onto and from the respective support member 24 and support flange 30 so that the pads can be easily removed and replaced when soiled. Other ways within the purview of the present invention could be devised to releasably attach the pads.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. An electrical connector contact cleaning device, comprising:

(a) an elongated body;

(b) a support member attached on and projecting outwardly from said body, said support member having opposite lateral sides, an outer end extending between said sides and spaced from said body, and a slot defined in said support member extending inwardly from said outer end toward said body and between said lateral sides of said support member;

(c) a cleaning material attached to said support member at least within said slot so as to define a cleaning cavity therein for receiving and cleaning at least one male electrical connector contact pin, the lateral length of said slot defined between said lateral sides of said support member being greater than the depth of said slot defined into said support member from said outer end thereof such that said cleaning cavity has a lateral length greater than its depth;

(d) a support flange attached on and projecting outwardly from said body, said support flange having opposite lateral sides, opposite surfaces extending between said lateral sided, and an outer end extending between said opposite sides and surfaces and being spaced from said body; and (e) a cleaning material attached to said support flange and overlying said opposite surfaces and said outer end thereof so as to define a cleaning protrusion thereon for inserting into and cleaning a female electrical connector contact receptacle, the lateral length of said support flange defined between said lateral sides thereof being greater than the depth of said support flange defined from said outer end thereof toward said body such that said cleaning protrusion has a lateral length greater than its depth.

2. The cleaning device of claim 1 wherein said cleaning material is at least one cleaning pad removably attached to said support member.

3. The cleaning device of claim 1 further comprises:

a housing attached to and projecting from said body so as to overly said support flange and said cleaning material thereon and thereby cover said cleaning protrusion but being spaced therefrom so as to permit receipt of the female receptacle within said housing and over said protrusion.

4. The cleaning device of claim 1 wherein said cleaning material is at least one cleaning pad removably attached to said support flange.

5. The cleaning device of claim 1 wherein said body has first and second opposite ends, said support member being attached on and projecting from said first opposite end of said body, said support flange being attached on and projecting from said second opposite end of said body.

6. The cleaning device of claim 5 wherein said body has means thereon for gripping of said device being located between said opposite end of said body.

7. The cleaning device of claim 1 wherein said body includes:

a perimeter frame composed of opposite side members interconnected by opposing end members and defining therewith a central opening; and a plurality of cross members extending across said central opening between and interconnected with said side members of said frame, said cross members being spaced from one another and from said end members of said frame so as to divide said central opening into a plurality of open slots for inserting a finger of a user's hand to grip said body.

8. The cleaning device of claim 7 wherein said support member is attached on one of said opposing end members of said body frame.

9. The cleaning device of claim 8 wherein said support flange is attached on the other of said opposing end members of said body frame.

10. An electrical connector contact cleaning device, comprising:

(a) an elongated body having first and second opposite ends and means located between said opposite end for gripping of said cleaning device;

(b) means on said first opposite end of said body for receiving a row of spaced male electrical connector contact pins and for cleaning the same, said male contact pin cleaning means including (i) a support member having inner and outer opposite ends and opposite lateral sides extending therebetween, said support member being attached at its inner end to said first opposite end of said body and projecting outwardly therefrom and having a slot open at said sides and said outer end of said support member, and (ii) a cleaning pad removably attached to said support member at least within said slot so as to define a cleaning cavity therein for receiving and cleaning at least one male electrical connector contact pin, the lateral length of said slot defined between said lateral sides of said support member being greater than the depth of said slot defined into said support member from said outer end thereof such that said cleaning cavity has a lateral length greater than its depth; and (c) means on said second opposite end of said body for inserting into a female electrical connector contact receptacle and for cleaning the same, said female contact receptacle cleaning means including (i) a support flange having opposite lateral sides, opposite surfaces extending between said lateral sides and inner and outer opposite ends extending between said opposite sides and surfaces, said support member being attached at its inner end to said second opposite end of said body and projecting outwardly therefrom, and (ii) a cleaning pad removably attached to said support flange and overlying said opposite surfaces and outer end thereof so as to define a cleaning protrusion thereon from inserting into and cleaning a female electrical connector contact receptacle, the lateral length of said support flange defined between said lateral sides thereof being greater than the depth of said support flange defined from said outer end thereof toward said body such that said cleaning protrusion has a lateral length greater than its depth.

11. The cleaning device of claim 10 wherein said body includes:

a perimeter frame composed so opposing side members interconnected by opposing end members and defining therewith a central opening; and a plurality of cross members extending across said central opening between and interconnected with said side members of said frame, said cross members being spaced from one another and from said end members of said frame so as to divide said central opening into a plurality of open slots defining said gripping means for permitting insertion of one or more fingers of a user's hand to grip said body.

12. The cleaning device of claim 11 wherein said male contact pin cleaning means is attached on one of said opposing end members of said body frame.

13. The cleaning device of claim 11 wherein said female contact receptacle cleaning means is attached on one of said opposing end members of said body frame.

14. An electrical connector contact cleaning device, comprising:

(a) an elongated rectangular plastic holder having at least one opening defined therethrough between opposite ends of said holder for facilitating gripping of said device by a user's hand;

(b) a cleaning cavity having a cleaning pad therein, said cleaning cavity being disposed on and projecting outwardly from one of said ends of said holder for receiving and cleaning a row of male electrical connector contact pins, said cleaning cavity having a pair of spaced lateral sides and an outer end spaced from said holder, the lateral length of said cleaning cavity defined between its lateral sides being grater than the depth of said cleaning cavity defined from its outer end thereof toward said holder; and (c) a cleaning protrusion having a cleaning pad thereon, said cleaning protrusion being disposed on and projecting outwardly from the other of said ends of said holder for inserting into and cleaning a female electrical connector contact receptacle, said cleaning protrusion having a pair of spaced lateral sides and an outer end spaced from said holder, the lateral length of said cleaning protrusion defined between its lateral sides being greater than the depth of said cleaning protrusion defined form is outer end toward said holder.

* * * * *